US008776317B2

(12) United States Patent
Atwell

(10) Patent No.: US 8,776,317 B2
(45) Date of Patent: Jul. 15, 2014

(54) METHOD AND APPARATUS FOR HANGING AN OBJECT

(71) Applicant: Gretchen Seewald Atwell, Austin, TX (US)

(72) Inventor: Gretchen Seewald Atwell, Austin, TX (US)

( * ) Notice: Subject to any disclaimer, the term of this patent is extended or adjusted under 35 U.S.C. 154(b) by 0 days.

(21) Appl. No.: 13/928,443

(22) Filed: Jun. 27, 2013

(65) Prior Publication Data

US 2013/0283570 A1 Oct. 31, 2013

Related U.S. Application Data

(62) Division of application No. 12/731,016, filed on Mar. 24, 2010, now Pat. No. 8,495,792.

(51) Int. Cl.
*E05D 15/00* (2006.01)

(52) U.S. Cl.
USPC ..... 16/94 R; 16/87.4 R; 16/95 R

(58) Field of Classification Search
USPC ..... 16/87.4 R, 94 R, 94 D, 95 R, 96 D; 52/741.1; 160/345
See application file for complete search history.

(56) References Cited

U.S. PATENT DOCUMENTS

| | | | | | |
|---|---|---|---|---|---|
| 3,346,909 | A * | 10/1967 | Blackburn | ..... | 16/94 D |
| 3,424,225 | A * | 1/1969 | Magnusson | ..... | 160/345 |
| 3,693,696 | A * | 9/1972 | Salzmann | ..... | 160/345 |
| 3,698,035 | A * | 10/1972 | Salzmann | ..... | 16/95 D |
| 4,229,857 | A * | 10/1980 | Toder | ..... | 16/95 R |
| 6,409,415 | B1 * | 6/2002 | Toder | ..... | 403/397 |

* cited by examiner

*Primary Examiner* — William Miller
(74) *Attorney, Agent, or Firm* — Colin P. Cahoon; Stephen Y. Liu; Carstens & Cahoon, LLP

(57) ABSTRACT

A method for hanging an object and apparatus for accomplishing the same. The invention describes an apparatus comprising a track, an upper flange attached to a track, and a carrier disposed in said track. The carrier is laterally moveable along the length of the track. In one embodiment the apparatus comprises a top unit and a base unit. The top unit comprises pins, a track, at least one carrier, and a lower flange. The base unit is affixed to a ceiling, and the top unit is affixed to the base unit via the pins. In one embodiment the anchors are not visible from below. Further, in one embodiment, the lower flange acts as a moisture barrier to protect the anchors.

9 Claims, 4 Drawing Sheets

METHOD AND APPARATUS FOR HANGING AN OBJECT

CROSS REFERENCE TO RELATED APPLICATION

This application is a divisional application of U.S. patent application Ser. No. 12/731,016, now U.S. Pat. No. 8,495,792, entitled "Method and Apparatus for Hanging an Object," filed Mar. 24, 2010, the technical disclosure of which is hereby incorporated by reference in its entirety.

BACKGROUND OF THE INVENTION

1. Technical Field

The present invention relates to a method and apparatus for hanging or supporting an object.

2. Description of Related Art

There are a variety of known devices used for hanging or supporting an object. Often the object must be able to be moved, such as curtains or drapes. As an example, curtains are often hung on curtain rods so that the curtains can be pulled or slid open or closed. As another example, shower curtains are often hung on rods which are not structurally attached to the shower walls. Rather, the rods typically have an internal spring which offers an external force to keep the rod positioned in the shower. However, often this force is insufficient to support the weight of the curtain and the rod tumbles down into the shower. This presents a dangerous and undesirable situation. Another downside for typical shower curtains is that they cannot be positioned flush against the top of the ceiling. Such a flush and seamless appearance is often aesthetically pleasing.

Consequently, it is desirable to provide an apparatus which can adequately support the hanging object. Furthermore, it is desirable that the apparatus exhibit a flush and seamless appearance. Finally, it is desirable that the apparatus be suitable in a high moisture environment.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures.

Generally, this invention relates to a method and apparatus for hanging or supporting an object. In one embodiment, the apparatus comprises two elements: a hanging object, and an assembly attached to a wall or ceiling from which the object is hung or supported. Virtually any object can be attached to the assembly including but not limited to curtains, drapes, a shower curtain, a privacy curtain, a bug net, etc. Such objects can be used to keep light out, to keep bugs away, to partition a room, create a room with a separate environment, etc. The assembly will be discussed in detail below in reference to the figures.

Figure 1:
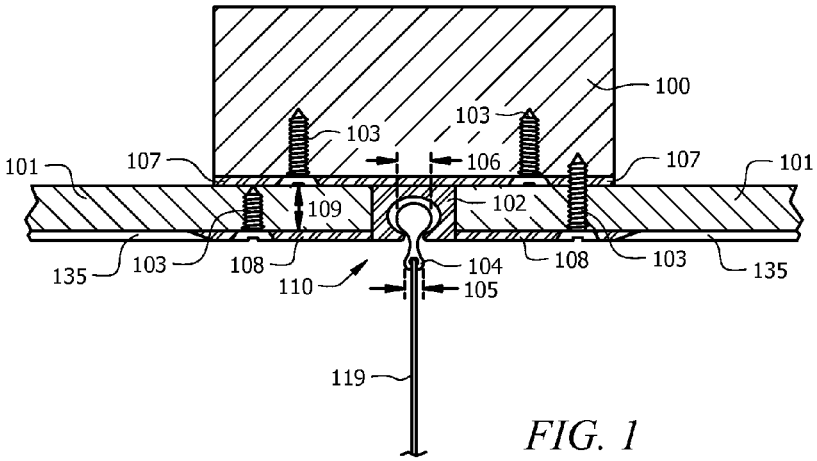
FIG. 1 is a cross-sectional view of the installed assembly in one embodiment.

FIG. 1 is a cross-sectional view of the installed assembly in one embodiment. In this embodiment, the assembly 110 is in the substantially same horizontal plane as the ceiling 101. As will be discussed in detail below, a reference to a ceiling should not be deemed limiting as other walls, such as vertical sidewalls or floors, are also suitable. In FIG. 1, the assembly 110 is seamless and flush with the ceiling 101. In the embodiment depicted, the assembly 110 comprises the track 102, at least one carrier 104 which is laterally moveable along the length of said track, an upper flange 107 comprising at least one anchor hole, a lower flange 108, and anchors 103. As depicted the lower flange 108 comprises at least one anchor holes, although in other embodiments the lower flange 108 does not comprise an anchor hole. The upper 107 and lower flanges 108 are coupled to the track 102. As used herein a "track" refers to a device which houses a carrier and which allows the carrier to move laterally along the length of the track. The track 102 can be formed to virtually any shape along its length. In one embodiment the track 102 is straight along its length whereas in other embodiments the track 102 has a curve. In other embodiments the track 102 is so shaped to be a continuous circle, square, or other geometric shape as viewed below. The track 102 can comprise a single continuous section or multiple sections inter-connected.

The assembly 110 further comprises a carrier 104. Carrier, as used herein, refers to an object which is at least partially placed within the track and which is laterally moveable within the track. The carrier 104 can be maintained in the track 102 by a variety of methods including having one dimension of said carrier 104 being larger than the open diameter of the track. As depicted, the carrier 104 comprises an upper portion and a lower portion. The upper portion has a diameter 106 which is greater than the open dimension of the track. Such an arrangement maintains the carrier's position within the track. Other methods known in the art of maintaining the carrier 104 within the track can also be utilized.

The carrier 104 can comprise any item which is capable of moving laterally along the length of the track 102. For example, the carrier 104 can comprise wheels, ball bearings, a shaped object, or other such devices which allow an object to travel the length of another object. In one embodiment the carrier 104 comprises a composition or coating which allows the carrier 104 to smoothly glide along the track 102 by, for example, reducing friction.

As discussed, in one embodiment the carrier 104 is dimensioned so that at least a portion of the carrier 104 is maintained within the track 102. In one embodiment, the carrier 104 can be introduced into an open end of the track 102 before installation. Additionally, the carrier 104 can comprise an internal spring such that the carrier 104 assumes one diameter for installation, and once installed assumes a different diameter. In another embodiment, the track comprises a spring-loaded endcap at the end of the tracks through which the carriers can be inserted or removed by manipulating the endcap. In yet another embodiment, the track 102 comprises an entry point through which the carrier 104 can be inserted or removed. The entry point can be positioned anywhere along the track 102. In one embodiment the entry point comprises a portion of the track with a wider diameter so that the carrier 104 can be inserted or removed. In such an embodiment the carrier 104 can be maintained within the track 102 by inserting a diameter restrictor, such as a screw, which prevents the carrier 104 from undesirably exiting the track 102 through the entry point. In another embodiment, the entry point comprises a portion of the track which can be opened or closed to allow the carrier 104 to be inserted or removed. After installation of the carrier 104, the entry point can be secured via screws or the like to maintain the entry point in a closed position. In one embodiment, the entry point is located at a point on the track 102 which will be subject to a lower load. For example, if the track 102 is used to hold a shower curtain, then the portion of the track 102 adjacent to the toilet will often be subject to a lower load and less strain because the person does not exit the shower at that location. Finally, in some embodiments the carriers 104 are pre-installed within the track 102. Those skilled in the art will appreciate the various methods of installing and securing a carrier 104 within a track 102.

As depicted the assembly 110 is secured via anchors 103 to a stud 100. As used herein "stud" refers to any structure to which the assembly 110 can be affixed and which offers sufficient support to the assembly 110. The term stud includes but is not limited to traditional studs such as 2" by 4" wooden boards, metallic studs, plywood, or sheetrock. Whether a stud will offer sufficient support is dependent upon a number of factors including what is being attached to the carrier 104. Those skilled in the art will understand what can qualify as a stud for a given embodiment. Also depicted in FIG. 1 is the ceiling 101, also referred to herein as ceiling material 101. In one embodiment the stud 100 and ceiling 101 comprise different materials. For example, the stud 100 comprises a wooden board whereas the ceiling 101 comprises sheetrock. In other embodiments, however, both the stud 100 and the ceiling 101 comprise the same material.

As depicted, the assembly 110 is secured via anchors 103 secured to the upper flange 107. In one embodiment, the upper flange 107 is flush against the stud 100. In one embodiment the upper flange 107 and the track 102 are made from a single piece of material, and in other embodiments the upper flange 107 is attached to the track 102 by soldering, welding, or other such ways known in the art. In one embodiment the upper flange 107 is directly attached to the track 102 whereas in other embodiments the upper flange 107 is indirectly coupled to the track 102 via other structure. The term "coupled" refers to a connection, either direct or indirect. Thus an object which is either directly attached or attached through another structure is considered coupled. In one embodiment the upper flange 107 extends for the entire length of the track 102, whereas in other embodiments the upper flange 107 is non-continuous along the length of the track 102. For example, in one embodiment the upper flange 107 may only be located at the ends of the track 102. Further, while the upper flange 107 is depicted as having both a left and right side, in other embodiments the upper flange 107 may only comprise a single side. This embodiment can be utilized, for example, when the assembly is to be installed flush against a vertical wall such that an upper flange 107 on both sides of the assembly 110 is impossible.

The upper flange 107 comprises at least one anchor hole. The assembly 110 is secured via at least one anchor 103 which are affixed to the upper flange 107 through the anchor holes. Anchors, as used herein, refers to a securing device and includes, but is not limited to, screws, nails, bolts, rivets, wall anchors, toggle bolts, and other devices known and used in the art. In one embodiment, the at least one anchor hole in the upper flange 107 is beveled such that the head of the anchor is flush with the upper flange 107. In one embodiment, there is a corresponding hole in the lower flange 108 so that the anchor can be screwed, drilled, or otherwise affixed by placing the affixing instrument through the hole in the lower flange 108. As an example, if the anchors comprise screws, the assembly can be attached by placing the screw through the holes in the upper and lower flanges and screwing the anchor 103 into the stud via a screwdriver. In one embodiment the upper flange 107 comprises a smaller anchor hole than the corresponding anchor hole in the lower flange 108. In such an embodiment a thinner anchor can be used in the upper flange 107 whereas a thicker anchor can be used in the lower flange 108. Further, in another embodiment a screw with a wider head is used for the lower flange 107 while a screw with a thinner head is used for the upper flange 108 so that it may fit through the anchor hole in the lower flange 107. In one embodiment a wood screw is used in the upper flange 107 whereas a sheetrock screw is used in the lower flange 108. Further, as depicted on the right side of lower flange 108, the anchor may extend beyond the upper flange 107. As depicted on the left side of the lower flange 108, the anchor 103 may extend only into the ceiling material 101. In still other embodiments, the anchor 103 extends from the lower flange 108 and secures into the upper flange 107. In one embodiment, the anchors are not visible from below the installed assembly.

In one embodiment the assembly 110 is affixed to the wall via a variety of anchors 103. For example, one embodiment comprises traditional wall anchors as well as screws. Thus, in one embodiment the upper flange 107 comprises multiple anchors holes for a variety of anchors. Further, in another embodiment, the lower flange 108 comprises at least one, and in one embodiment multiple anchor holes. Like the upper flange 107, in the embodiment depicted the lower flange 108 comprises at least one anchor hole. In one embodiment the lower flange 108 comprises multiple anchor holes for a variety of anchors. In some embodiments, an anchor is attached to the lower flange 108 which offers the assembly 110 additional support. Further, in one embodiment the anchor attached through the lower flange 108 locks the ceiling material 101 in place. In such embodiments the ceiling material is secured by the anchor through the lower flange. In yet another embodiment, the lower flange 108 comprises small teeth on the side which face the ceiling material 101 which help to grip and secure the ceiling material. Other devices for securing the ceiling material 101, such as screws, pins, or nails can also be employed. As noted above, in other embodiments the lower flange 108 does not comprise an anchor hole.

Like the upper flange 107, the lower flange 108 can be integral with the track 102 or can be attached to the track 102 by soldering, welding, or other ways known in the art. Further, the lower flange 108 can be directly attached to the track 102 or indirectly coupled to the track 102 through intermediate structure. As depicted, the lower flange 108 is flush against the ceiling 101. As such, the assembly 110 appears seamless against the ceiling 101 which is often aesthetically desirable. In one embodiment, the bottom of the track 102 is in substantially the same plane as the ceiling material 101. As depicted in FIG. 1, the lower flange 108 has tapered ends. Often the ceiling material 101 comprises sheetrock which often also has tapered ends. As depicted, the ceiling material 101 has been taped with tape 135. The tape can comprise fiberglass tape, joint tape, and other such material known in the art. The joint is then covered, known as floating, with a joint compound, plaster or other materials known in the art and textured for consistency with the rest of the ceiling. Such consistency offers a pleasing visual appeal. Consequently, the lower flange is in substantially the same plane as the ceiling material 101 and tape 135.

In one embodiment, the lower flange 108 extends for the entire length of the track 102. In another embodiment, the lower flange 108 is not continuous along the length of the track 102. As with the upper flange 107, in some embodiments there is only a left or right portion of the lower flange 108. Likewise, in one embodiment there is no lower flange 108.

As depicted, there is a distance 109 between the upper and lower flanges. This distance can vary with specific embodiments. In one embodiment the distance ranges from a quarter inch to a full inch. Other common distances include ½" or ⅝" for sheetrock, and ⅜" and ½ for backer board. In one embodiment, ceiling material 101 is placed between the upper and lower flanges. The ceiling material 101 can comprise any material used for ceilings including sheetrock, wood, tile, etc. As noted above, the ceiling material 101 can comprise the same or different material than the stud 100.

In one embodiment, the distance 109 between the upper and lower flanges is different on each side of the track 102. For example, the left side of the track 102 may comprise sheetrock. Thus, the distance 109 between the upper and lower flanges on the left side is sized to accommodate the sheetrock. However, the right side of the track can comprise a thinner layer, for example a cement board layer. As such, the distance 109 between the upper and lower flanges on the right side is sized to accommodate the cement board. In other embodiments the right or left side is sized to accommodate thicker material. For example, the left side may comprise ¾ inch sheetrock whereas the left side comprises one inch sheetrock. In still another embodiment one side may comprise sheetrock whereas the other side comprises thicker or thinner backer board. In still another embodiment one side may comprise sheetrock whereas the other side comprises thicker or thinner cement board and tiles. Accordingly, the distances between the upper and lower flanges on the left and right side of the track may be different, and a different material may be inserted in each side.

In another embodiment, the lower flange 108 and/or the upper flange 107 is adjustable relative to the track 102. Accordingly, the distance 109 between the upper and lower flange 107 can be adjusted to accommodate ceiling material 101 of varying thicknesses. The upper or lower flanges can be adjusted in a variety of ways including inserting spacers between the track 102 and the upper 107 or lower 108 flange or both. Those skilled in the art will understand the various ways to make the upper and lower flanges vertically adjustable. Further, in still another embodiment, the assembly 110 comprises an additional flange. The additional flange can be used to support additional layers. As with the lower flange 108, the additional flange may only be on the left side, the right side, or may be on both sides. In one embodiment the additional flange is located below the lower flange 108. For example, the lower flange 108 may secure a layer of cement board while the additional flange supports a tile layer. In still another embodiment, the lower flanges 108 are not in the same plane but, for example, the additional flange located on the right of the figure and below the right lower flange 108 is in the same plane as the left lower flange 108. In other embodiments the additional flanges are in the same plane.

The assembly 110 can be installed in a variety of manners. In one embodiment, the assembly 110 is installed by removing a portion of the ceiling 101, affixing the assembly 110 to the stud 100 by inserting at least one anchor through the anchor holes in the upper flange 107, and placing ceiling material 101 into the gap 109 between the upper 107 and lower 108 flange. Thus, in one embodiment, the distance 109 between the upper and lower flanges is slightly greater than the thickness of the ceiling material 101. In other embodiments, at least two anchors are used to affix the assembly to a wall. As discussed, one anchor 103 may comprise a wall anchor whereas another anchor, which may comprise a different length, is comprised of a screw. After affixing the assembly 110, the carrier 104 is inserted and an object 119 can be hung or supported from the carrier 104. In other embodiments, the carrier 104 is pre-installed within the track 102 so there is no need to install the carrier 104. In one embodiment, after placing ceiling material the ceiling material is taped and floated. In one such embodiment, the ceiling material 101 and the lower flange 108 are taped and floated such that the ceiling material 101 and the lower flange 108 are in the same plane. In a further embodiment, after being taped and floated the ceiling material 101, and even portions or all of the lower flange 108, is then textured and/or painted. In other embodiments, there is no need to remove the ceiling material 101 prior to installation. For example, the assembly 110 can be installed during construction of the house or during framing. In another embodiment, the assembly 110 is installed during remodeling wherein the ceiling material 101 is already removed.

Because the lower flange 108 is substantially flush against the ceiling material 101, it is substantially seamless with the ceiling material 101. Thus, in one embodiment the lower flange 108 is in substantially the same horizontal plane as the ceiling material 101.

Placing tracks in a high moisture environment, such as above or within a shower, can cause moisture problems with the components of the track. For example, the ceiling material 101 can experience moisture damage which results in cracks, swelling, or mold growth. Likewise, moisture can damage the stud 100 such that the anchor 103 fails to properly secure the track. Further, moisture can cause any metallic components to rust. The lower flange 108 helps to prevent such moisture damage by preventing moisture from reaching and damaging the anchor 103, the stud 100, and the covered ceiling material 101. As such, the lower flange 108 acts as an inverted umbrella protecting the covered contents from moisture damage. Accordingly, in one embodiment the lower flange 108 is a moisture barrier which protects contents above the lower flange 108 against direct moisture contact. In one embodiment the assembly comprises a gasket to prevent moisture damage. The damage can be located above or below the lower flange 108 or the upper flange 107. A gasket is useful in preventing the passage of water and can be utilized in virtually any embodiment discussed herein. In one embodiment, the lower flange 108, the carrier 104, and/or the track 102 comprises a material which is rust resistant.

As depicted in FIG. 1, there is no anchor 103 located within the channel of the track 102. The term "channel" refers to the open portion of the track. This is beneficial for a variety of reasons. First, if there is an anchor located within the channel of the track, then the anchor 103 can project into the path of the carrier 104 and prevent or inhibit movement of the carrier 104 along the length of the track 102. By locating the anchors 103 outside of the channel of the track 102, this is avoided. Second, if an anchor 103 is located within the channel of the track 102, then the anchor 103 can be subjected to direct moisture damage. By protecting the anchors 103 via the lower flange 108, the integrity of the anchor 103, and thus, the stability of the assembly is maintained and/or prolonged. Thus, in one embodiment the anchors 103 are protected from direct moisture contact. Further, in one embodiment the channel does not comprise ceiling material which also protects the ceiling material from direct moisture damage. Finally, because the channel does not comprise an anchor 103, any anchor 103 is hidden by the ceiling material 101 and the lower flange 108. As such, the anchors 103 are not visible from below the assembly 110. This is beneficial as such an arrangement increases the aesthetics of the installed assembly.

Figure 2:
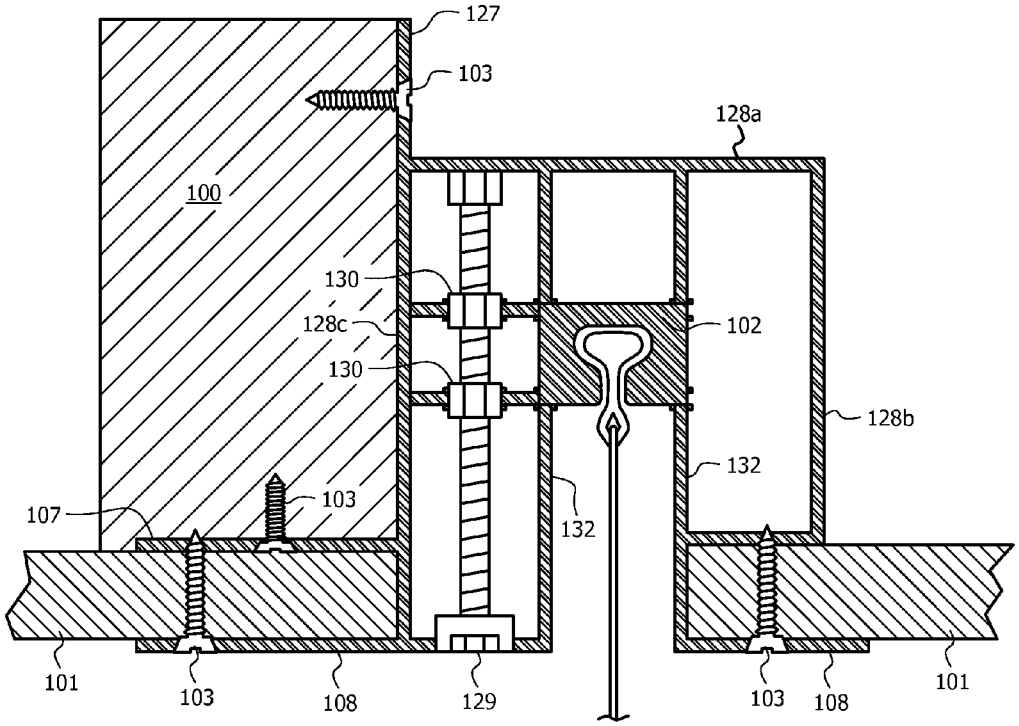
FIG. 2 is a cross-sectional view of the installed assembly in one embodiment comprising a recessed track.

While in the embodiment depicted in FIG. 1 the track is between the upper flange 107 and the lower flange 108, in other embodiments the track 102 is above the upper flange 107. FIG. 2 is a cross-sectional view of the installed assembly in one embodiment. As depicted the track 102 is located above the upper flange 107. Such an embodiment offers the ability for the track 102 to be recessed into the ceiling. This would allow a portion of the hanging object to extend above the ceiling.

FIG. 2 shows one embodiment wherein the track 102 is vertically adjustable. Such an embodiment allows the height of the track 102 to be varied. For example, the track 102 can be lowered to install curtains and then subsequently raised to their desired height.

The track 102 comprises a housing comprised of at least one intermediate flange 128. As depicted, the housing comprises a horizontal top intermediate flange 128*a* located above the track 102 and two opposing vertical intermediate flanges 128*b*, 128*c*. The top horizontal flange 128*a* attaches to the two opposing left 128*c* and right vertical intermediate flanges 128*b*. The housing couples the track 102 with the upper 107 and lower 108 flanges. While FIG. 2 depicts the track 102 as being adjustable relative to the upper flange 107, in other embodiments the track 102 is not adjustable.

Coupled to the lower flange 108 is an adjusting device 129. As depicted the adjusting device 129 comprises a screw secured to the lower flange 108. The adjusting device can comprise any device which upon manipulation can cause an attached mounting device 130 to raise or lower. Suitable devices include a screw, hydraulic fluid, and other devices known in the art. As discussed, a mounting device 130 is also coupled to the adjusting device 129. The mounting device 130 is also coupled to the track 102. As the adjusting device 129 is adjusted, such as by rotating the screw, the mounting device 130 and the track 102 both move relative to the adjusting device 129. As such the track 102 can be raised or lowered by manipulating the adjusting device 129. In one embodiment the adjusting device 129 is recessed within the lower flange 108 so that it is not easily seen from below. In one embodiment the adjusting device 129 comprises a recessed screw head. Those skilled in the art will understand there are other methods for adjusting the height of a track.

As depicted, the housing further comprises suspension flanges 132 which are coupled to the top intermediate flange 128*a* and the upper 107 and lower flanges 108. The optional suspension flanges 132 offer additional support and offer an additional way to couple the track 102 to the intermediate flanges 128 and the upper 107 and or lower 108 flanges. The suspension flanges 132 can comprise stationary rods upon which the track 102 glides. For example, on one embodiment the track 102 comprises holes through which the suspension flanges 132 are placed. The suspension flanges 132 help keep the track 102 aligned and yet allow the track 102 to be vertically moveable. It should be noted that not all embodiments comprise a suspension flange 132. Further, it should be noted that in some embodiments the intermediate flange 128 acts as a suspension flange 132. For example, in FIG. 2, if the adjusting device 129 were removed the track would be connected to the left intermediate flange 128*c*. The track 102 would then be vertically adjustable along the left intermediate flange 128*c*. As such, the left intermediate flange 128*c* would function as a suspension flange 132.

In other embodiments the track 102 is further coupled to another adjusting device, referred to as an initial placement device. The initial placement device can comprise any type of adjusting device previously discussed, and can operate as the adjusting devices previously discussed. In one embodiment, the initial placement device comprises a threaded screw which raises or lowers the track 102. In one embodiment the initial placement device is secured to the top of the intermediate flange 128*a* and is coupled to the track 102. Accordingly, if the initial placement device is manipulated so that the track 102 is lowered, then the adjusting device 129, which is also coupled to the track 102, also reacts. In one embodiment wherein the initial placement device and the adjusting device 129 comprise threaded screws, the initial placement device comprises larger threads than the adjusting device 129. Accordingly, a full rotation of the initial placement device results in a larger adjustment than the adjusting device 129. In such embodiments the initial placement device is used to obtain the initial location while the adjusting device 129 allows to fine-tune the final location of the track 102. Further, the adjusting device 129 can be manipulated after installation whereas the initial placement device cannot generally be manipulated after installation because it is located atop the intermediate flange 128*a*. It should be noted that not all embodiments comprise the initial placement device. Some embodiments only comprise an adjusting device 129. Still other embodiments comprise an initial placement device but do not comprise an adjusting device 129.

As depicted, the left and right upper flanges 107 are in the same horizontal plane. In other embodiments, however, the left and right upper 107 and/or lower flanges 108 are not located in the same horizontal plane.

FIG. 2 illustrates a lower left flange 108 which extends beyond the upper flange 107. The extended portion of the lower flange 108 comprises an anchor hole and an anchor 103. The anchor 103 secures the ceiling material 101 in its position between the upper 107 and lower 108 flange. The left upper flange 103 comprises an anchor 103 which secures into the stud 100.

FIG. 2 also illustrates a supplemental flange 127 which offers yet another opportunity to secure the assembly to a wall 101 or stud 100. As depicted the supplemental flange 127 extends from the intermediate flange 128*c* and comprises an anchor hole. A supplemental flange is any flange which extends from an intermediate flange. The supplemental flange 127 can extend in virtually any direction to offer additional support.

To install the assembly depicted in FIG. 2, the initial placement device 131 is manipulated until the track 102 is in the first desired location. Then, the assembly is secured to a wall or stud 100. As previously discussed, sheetrock or other ceiling material may have to be removed prior to installation. Alternatively, the assembly can be installed during the construction or renovation stage. After the assembly is secured, the ceiling material is replaced and secured. As depicted the ceiling material 101 is placed between the upper 107 and lower 108 flanges and secured with anchors 103. After the assembly is installed, the location of the track 102 can be adjusted via the adjusting device 129. The result is an adjustable track which can be recessed within the ceiling. The assembly depicted in FIG. 2 is easily installed. Further, due to the housing and the upper and lower flanges, the assembly is structurally sound. As will be discussed in more detail below, FIG. 2 serves as one example of an embodiment which can be modified to comprise a particle migration barrier.

Figure 3:
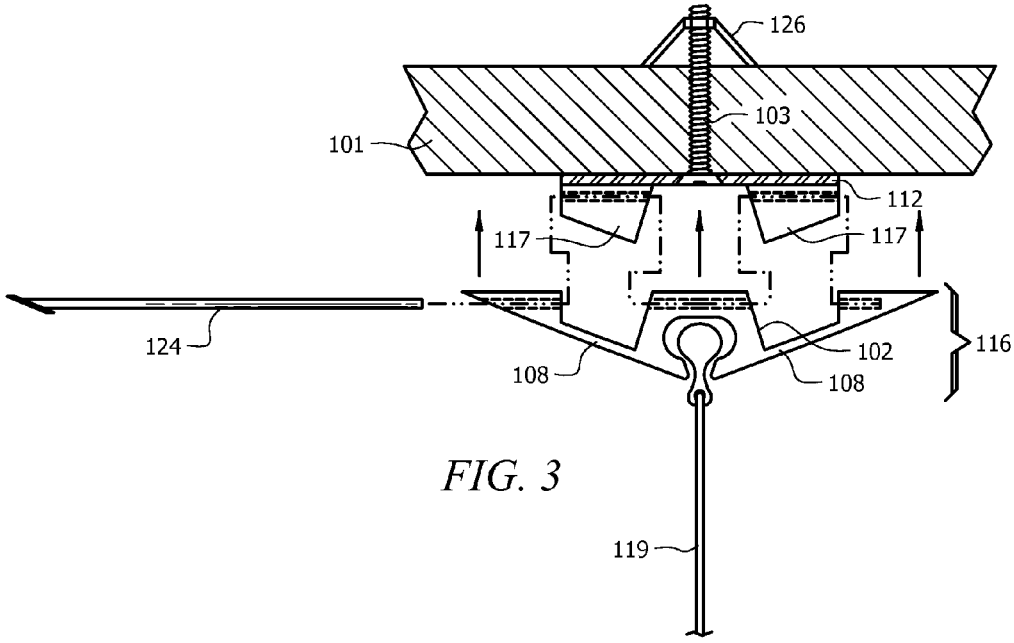
FIG. 3 is a cross-sectional view of the installed assembly in one embodiment comprising a base unit and utilizing a pin.

FIG. 3 is a cross-sectional view of yet another embodiment of the instant invention. FIG. 3 illustrates an embodiment wherein the assembly 110 is affixed to the external surface of a stud 100 or ceiling 101. In such an embodiment, the ceiling material 101 need not be cut or otherwise altered prior to installation. Further, the assembly can be installed even in the absence of a traditional support stud.

As depicted in FIG. 3, the assembly 110 comprises a base unit 112 and a top unit 116. The top unit 116 comprises a track 102, at least one carrier 104 which is disposed in said track and which is laterally moveable along the length of the track 102, and a lower flange 108 attached to said track. The track 102 and carrier 104 can operate as discussed above.

Figure 4:
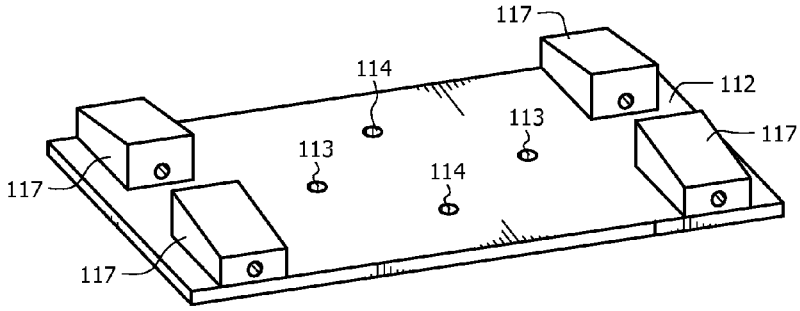
FIG. 4 is a perspective view of the base unit in one embodiment comprising teeth.

In this embodiment a base unit 112, illustrated in FIG. 4, is secured to a ceiling as discussed below. In the embodiment depicted, the base unit 112 comprises teeth 117 which mate with a tooth gap in the top unit 116. The teeth 117 and the top unit 116 both comprise a pin hole through which the pin 124 may be inserted. Accordingly, when the top unit 116 is mated with the base unit 112, the pin holes in each piece align and the pin 124 can be inserted. When the pin 124 is inserted the top unit 116 becomes secured to the base unit 112. In one embodiment both the pin 124 and the top unit 116 comprise threads so that the pin 124 can be screwed into a threaded portion of the top unit 116. Either the base unit 112 or the top unit 116 or both can be threaded. To remove the top unit 116, the pin 124 is simply withdrawn or unscrewed. Such an embodiment allows for easy installation and allows for easier carrier 104 change or replacement. For example, rather than having to change the carrier 104 with the track 102 installed, the top unit 116 can be removed and the carrier 104 can be changed or replaced at a comfortable height or location.

The pins 124 can be installed horizontally, as depicted, vertically, or angled. Thus, the pin holes can either align horizontally, vertically, or angled. In the embodiment depicted, only a single pin, installed through the horizontally aligned pin holes is needed to secure a segment of the base unit 112 to the top unit 116. The assembly may require additional pins depending on the weight of the object being hung. For example, in one embodiment a single pin may secure a five foot section of a top unit 116 to a base unit 112. Thus, a top unit 116 which is ten feet in length will require two horizontal pins in series. If a heavier object is being hung, then a single pin may only secure a one foot section of the top unit 116. Likewise, a vertical pin, such as a screw, positioned through the pin holes of the top 116 and base units 116 may be used to secure the top unit 116 to the base unit 112. In such an embodiment, the pin holes may comprise threads.

FIG. 4 is a perspective view of the base unit for an embodiment utilizing a pin as discussed above. In the embodiment depicted, the base unit 112 is first affixed to the ceiling 101 via anchors 103. As depicted the base unit 112 the anchor 103 further comprises a toggle bolt 126. Such devices are helpful when securing an object to sheetrock. In one embodiment, the base unit 112 will have the same shape as the track 102. Therefore, if the track 102 is straight the base unit 112 will also be straight. In one embodiment the base unit 112 is wider than the top unit 116. In one embodiment the base unit 112 is the same width as the top unit 116, whereas in other embodiments the top unit 116 is wider than the base unit 112.

As depicted in FIG. 4, the base unit 112 comprises at least one anchor hole 113. The anchor hole 113 is the hole through which the anchor 103 will affix the base unit 112 to the ceiling 101. In one embodiment the assembly comprises at least two anchors 103 comprising dissimilar lengths. For example, one anchor 103 may be a 3-inch long wall anchor whereas the additional anchors are shorter screws. As depicted the base unit 112 comprises a plurality of anchor holes 113 as well as a plurality of supplemental support holes 114 through which the base unit 112 may be further secured to the wall or ceiling.

As shown the base unit 112 comprises solid teeth 117, however in other embodiments the teeth 117 are hollow. The teeth 117 can comprise any shape such as rectangular, triangular, and circular. Those skilled in the art will understand that the teeth 117 can be made separately and attached to the base unit 112 or the teeth 117 and the base unit 112 can be made integrally through, for example, die-casting. Further, while the embodiment illustrated shows the teeth being located on the base unit 112, in other embodiments the top unit 116 comprises the tooth whereas the base unit 112 comprises the tooth gap.

Figure 5:
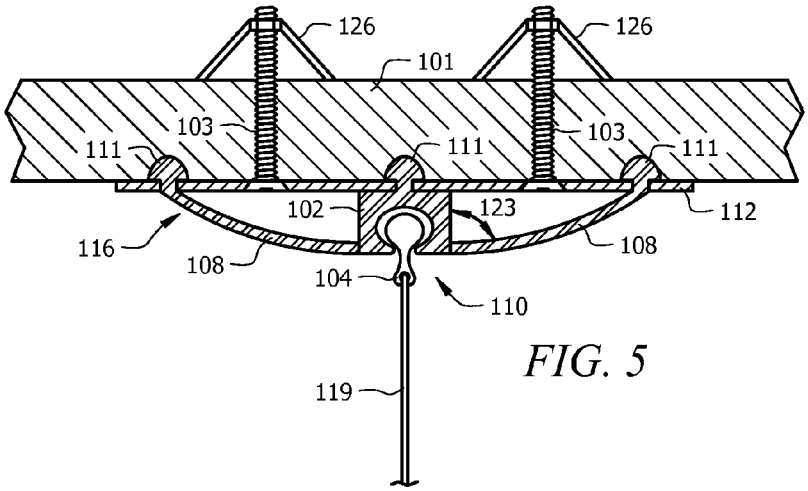
FIG. 5 is a cross-sectional view of one installed assembly in one embodiment comprising a base unit.

FIG. 5 is a cross-sectional view of the installed assembly in another embodiment comprising a base unit. As depicted in FIG. 5, the assembly 110 comprises a base unit 112 and a top unit 116. The top unit 116 comprises a track 102, at least one carrier 104 which is disposed in said track and which is laterally moveable along the length of the track 102, a lower flange 108 attached to said track, and at least one pin 111. The track 102 and carrier 104 can operate as discussed above. The top unit 116 is affixed to the base unit 112 via the at least one pin 111.

Figure 6:
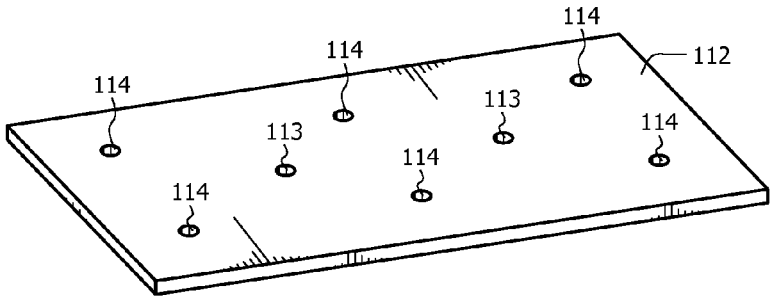
FIG. 6 is a perspective view of the base unit in one embodiment.

FIG. 6 is a perspective view of the base unit in one embodiment. In the embodiment depicted, the base unit 112 is first affixed to the ceiling 101 via anchors 103. The base unit 112 of this embodiment can operate as discussed above. As depicted in FIG. 6, the base unit 112 comprises at least one anchor hole 113 and at least one pin hole 114. While depicted as being a simple hole, the pin hole 114 may comprise a raised solid or hollow structure to which the pin attaches. The anchor hole 113 is the hole through which the anchor 103 will affix the base unit 112 to the ceiling 101. In one embodiment the assembly comprises at least two anchors 103 comprising dissimilar lengths. For example, one anchor 103 may be a 3-inch long toggle anchor whereas the additional anchors are shorter screws, such as self drilling dry-wall anchors or other such industrial anchors. As depicted the base unit 112 comprises a plurality of anchor holes 113 as well as a plurality of pin holes 114. In other embodiments the base unit comprises a plurality of supplemental holes (not shown) through which the base unit 112 may be further secured to the wall or ceiling.

Referring back to FIG. 5, the figure depicts the lower flange 108 attached to the track 102 at an angle 123. In one embodiment the angle 123 varies from about 89 degrees to about 5 degrees. In another embodiment, the angle varies from about 25 degrees to about 65 degrees, and in another embodiment the angle varies from about 35 degrees to about 50 degrees.

As depicted in FIG. 5, pins 111 are attached to the lower flange 108 and the top of the track 102. In other embodiments the pins 111 are located only on either the track 102 or the lower flange 108 or a combination thereof. In one embodiment the pin 111 is integral with the lower flange 108. In other embodiments the pin 111 secures to the lower flange 108. The pins 111 attach the top unit 116 to the base unit 112 via the pin holes 114.

The pins 111 can comprise a variety of devices including pinch pins, spring pins, tack pins, screws, etc. The pins 111 can also be similar to the pin 124 depicted in FIG. 3. In operation, the pins 111 are inserted through the pin holes 114 and remain in place. This can be accomplished in a variety of ways including a spring loaded pin whereby the spring collapses to pass through the hole and expands once passed. Additionally, the pins can comprise a screw or other device whereby a portion of the pins 111 expands once it has passed through the pin holes 114. Further the pins 111 may be simply forced through the pin holes 114. In one embodiment the pins 111 can be removed in the same manner in which they were installed. In yet another embodiment the pins 111 comprise screws such as Allen screws which can be manipulated to attach through the pin holes 114. Additionally, the pin holes 114 may comprise a nut or the like through which the pins 111 affix. In still another embodiment, the pins 111 are attached to the anchors 103. In one such embodiment the anchors have an internal set of threads into which the pins 111 are affixed. In another embodiment, the anchors 103 comprise a nut or other such item through which the pins 111 can be attached. Such an embodiment allows for easier installation as the number of holes through the ceiling are reduced. Those skilled in the art will understand the different pins 111 which can be utilized.

After the base unit 112 is installed on the ceiling material 101, the top unit 116 is attached to the base unit 112 via the pins 111. In one embodiment the base unit 112 is sufficiently separated from the ceiling material 101 to allow space for the installation of the pins 111. This can be accomplished with any means known in the art, including providing a washer on the ceiling side of the base unit 112 which provides a small gap between the ceiling material 101 and the base unit 112. In other embodiments, a small hole may be drilled into the ceiling material 101 to provide sufficient space for the installed pins 111. Further, in other embodiments the base unit 112 may comprise a housing which can accept and house the pins 111.

The installed assembly 110, while not completely flush in all embodiments, appears flush and seamless with the ceiling. As those skilled in the art will understand, the width of the lower flange 108 can be increased, and the angle between the track 102 and the lower flange increased, to make the assembly 110 appear more seamless with the ceiling. Thus, in one embodiment the lower flange 108 extends beyond the base unit 112. As an example, if the base unit 112 is three inches wide, the lower flange 108 can extend an inch on both sides of the base unit 112 and cover a width of five inches. In one embodiment the base unit varies from a width of 1 to 8 inches, while in another embodiment the base unit varies from a width of 2 to 4 inches. In still another embodiment, the base unit is about 3.5 inches. In one embodiment the distance between the ceiling and the bottom portion of the track 102 is less than two inches, while in other embodiments it is less than ½ of an inch.

As noted above, the lower flange 108 protects the anchors 103 and the ceiling material 101 from moisture damage. The lower flange 108 operates as a moisture barrier to prevent moisture from directly contacting the portion of the ceiling material 101 above the lower flange 108. As previously noted, the length of the lower flange 108 can be increased to cover, and thus protect, a larger area of ceiling material 101.

In the embodiment depicted in FIG. 5, there is no anchor located in the channel of the track 102. As noted previously this results in numerous benefits including keeping the anchor 103 from direct moisture contact. Further, because the anchors are located on the ceiling side of the lower flange 108 the anchors are not visible from below the assembly 110.

In one embodiment the base unit 112 further comprises a gasket. The gasket is located on the ceiling side of the base unit 112. Consequently, when the pins 111 are inserted through the corresponding holes 114, the gasket seals against the pins 111 and further restricts moisture from reaching the ceiling material 101. Additionally, the gasket may be located around the perimeter of the base unit 116 further preventing moisture from seeping in where the top unit and base unit connect. In still other embodiments the top unit comprises a gasket.

To install the track assembly the base unit is first affixed to a wall by inserting at least one anchor through said at least one anchor hole. Next, the top unit is affixed to said base unit by inserting at least one pin into said at least one pin hole.

Figure 7:
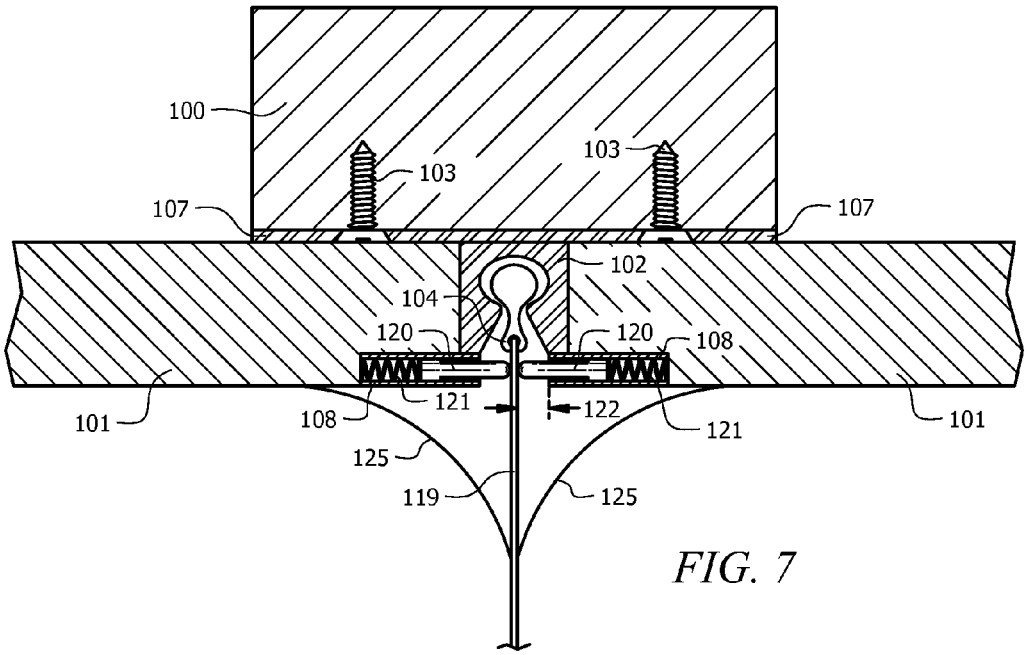
FIG. 7 is a cross-sectional view of one installed assembly comprising a particle migration barrier.

FIG. 7 is a cross-sectional view of one installed assembly comprising a particle migration barrier. Often it is desirable to keep particles from one side of the curtain 119 separated from the other side of the curtain 119. One such example includes a field operating or emergency room such as those used by Doctors during a natural disaster. Often these rooms are temporary structures which are quickly set up and disassembled. For example, in emergency situations where hospital rooms are unavailable, make-shift operating rooms are often set up near the emergency which offers a medical team a place to perform surgery or otherwise treat their patients. In such situations, it is often desirable to keep the room sanitized and free from particles on the outside of the room. Another example is a room for painting cars or other materials. In such a situation it is desirable to keep paint on one side of a curtain contained. FIG. 7 shows an embodiment which may be utilized to provide a curtain which creates or separates a room. The embodiment shown prevents particles from migrating up the curtain 119 on one side and migrating down on the other side. The embodiment shown utilizes any similar structure as previously described but further comprises a pressure valve 120. In one embodiment the pressure valve 120 comprises a continuous piece which covers the length of the track 102. In other embodiments, the pressure valve 120 comprises several individual pieces which are interlocked or otherwise attached.

The pressure valve 120 can come in a variety of forms. As illustrated the pressure valve 120 comprises a pressure source 121 which forces the pressure valve 120 to contact the curtain 119. The pressure source 121 can comprise a spring, coil, memory metals, or other such compression device. The pressure source 121 can also comprise compressed air or other fluids such as hydraulic fluid. Those skilled in the art will understand which pressure sources will be suitable.

The pressure valve 120 can be comprised of different materials including plastic, rubber, metal, wood, etc. Other specialty materials may be selected depending upon the embodiment employed and the particles present.

In operation, the pressure source 108 places pressure on the pressure valve 120. The pressure valve 120 acts as a gasket to prevent particles from migrating upward beyond the pressure valve 120. In one embodiment, the pressure source 121 offers sufficient pressure to prevent particles form migrating but not such great pressure that the curtain can not be moved. In one embodiment the pressure source 121 can be adjusted to increase or decrease the pressure supplied to the pressure valve 120. For example, if the pressure source 121 comprises a spring, then the spring can be lengthened or shortened via an adjustable spring to adjust the spring strength. Those skilled in the art will understand various ways to adjust the pressure source 121.

The curtain may further comprise a top gasket 125 which extends outward to further prevent the migration of particles. Further, while the pressure valve 120 is shown as being located within the lower flange 108, in other embodiments the pressure valve 120 is located below the lower flange 108.

The pressure valve 120 may be utilized in a variety of embodiments. For example, the pressure valve 120 may be utilized in the embodiments shown in FIG. 2 and FIG. 4. As previously stated, the pressure valve 120 may be located in or below the lower flange.

While one embodiment of the assembly has been described as being attached to a ceiling, in other embodiments the track assembly is attached to a vertical wall or floor. For example, in one embodiment track assemblies are attached to opposing vertical walls. Blinds or curtains are then attached to the track assemblies, and the blinds can be raised or lowered. Further in still another embodiment, one track assembly is installed in the ceiling while another track assembly is installed on a floor. Thus, the curtain is affixed to both the ceiling and the floor. Such embodiments may be employed in conjunction with a pressure valve to create an entire wall which prevents particle migration. As such, an entire room can be constructed which prevents particle migration from either inside or outside of a room.

While the invention has been particularly shown and described with reference to a preferred embodiment, it will be understood by those skilled in the art that various changes in form and detail may be made therein without departing from the spirit and scope of the invention.

What is claimed is:

1. An assembly disposed between pieces of ceiling material, said assembly comprising:

a track, an upper flange coupled to said track, wherein said upper flange comprises at least one anchor hole, and wherein said upper flange extends in a horizontal plane approximately parallel to said track;

at least one carrier disposed in said track, wherein said at least one carrier is laterally moveable along the length of said track;

a lower flange coupled to said track, wherein said lower flange extends in a horizontal plane approximately parallel to said track; and wherein further the upper flange and the lower flange cooperate to form openings there between and on either side of said track for receiving the respective pieces of ceiling material in substantially the same horizontal plane as the assembly.

2. The assembly of claim 1 wherein said lower flange extends for the entire length of said track.

3. The assembly of claim 1 wherein said lower flange is wider than said upper flange.

4. The assembly of claim 1 wherein said lower flange is a moisture barrier for said top flange.

5. The assembly of claim 1 wherein said track comprises a channel, and wherein said channel does not comprise an anchor.

6. The assembly of claim 1 wherein said track is between said upper and said lower flanges.

7. The assembly of claim 1 wherein said lower flange comprises at least one anchor hole.

8. The assembly of claim 1 wherein said upper flange is directly attached to said track.

9. The assembly of claim 1 wherein said lower flange is directly attached to said track.

* * * * *